US006446264B2

(12) United States Patent
Fairhurst et al.

(10) Patent No.: US 6,446,264 B2
(45) Date of Patent: Sep. 10, 2002

(54) ARTICLES OF CLOTHING

(75) Inventors: Fiona Fairhurst, Nottinghamshire (GB); Jane Cappaert, Arlington, MA (US)

(73) Assignee: Speedo International Limited, Nottingham (GB)

( * ) Notice: Subject to any disclaimer, the term of this patent is extended or adjusted under 35 U.S.C. 154(b) by 0 days.

(21) Appl. No.: 09/739,429

(22) Filed: Dec. 18, 2000

(30) Foreign Application Priority Data

Dec. 17, 1999 (GB) ..... 9929867

(51) Int. Cl.[7] ..... A41D 7/00
(52) U.S. Cl. ..... 2/69; 2/67; 2/2.15
(58) Field of Search ..... 2/69, 67, 78, 79, 2/82, 108, 113, 115, 227, 228, 238, 2.15

(56) References Cited

U.S. PATENT DOCUMENTS

| | | | | | |
|---|---|---|---|---|---|
| 3,086,214 | A | | 4/1963 | Lash | |
| D202,976 | S | * | 11/1965 | O'Neill | D3/17 |
| 3,763,498 | A | * | 10/1973 | Rector | 2/2.1 R |
| 4,067,064 | A | * | 1/1978 | Cerniway et al. | 2/2.1 R |
| 4,179,754 | A | * | 12/1979 | Denu | 2/67 |
| 4,625,336 | A | | 12/1986 | Derderian | |
| 4,698,847 | A | | 10/1987 | Yoshihara | |
| 4,999,845 | A | * | 3/1991 | Jenks, Jr. et al. | 2/2.1 |
| 5,033,116 | A | * | 7/1991 | Itagaki et al. | 2/67 |
| 5,189,736 | A | | 3/1993 | Price | |
| 5,263,923 | A | * | 11/1993 | Fujimoto | 602/2 |
| 5,282,277 | A | * | 2/1994 | Onozawa | 2/69 |
| 5,367,708 | A | * | 11/1994 | Fujimoto | 2/22 |
| 5,699,559 | A | * | 12/1997 | Sano | 2/67 |
| 5,839,122 | A | * | 11/1998 | Dicker et al. | 2/67 |
| 5,896,578 | A | * | 4/1999 | Hunter et al. | 2/2.15 |
| 5,898,934 | A | * | 5/1999 | Hunter et al. | 2/2.15 |
| 5,960,474 | A | * | 10/1999 | Dicker et al. | 2/69 |
| 5,978,966 | A | * | 11/1999 | Dicker et al. | 2/69 |
| 6,047,405 | A | * | 4/2000 | Wilkinson | 2/69 |
| 6,047,406 | A | * | 4/2000 | Dicker et al. | 2/69 |
| 6,098,198 | A | * | 8/2000 | Jacobs et al. | 2/69 |
| 6,195,801 | B1 | * | 3/2001 | Meyers | 2/67 |
| 6,231,488 | B1 | * | 5/2001 | Dicker et al. | 482/124 |
| 6,260,199 | B1 | * | 7/2001 | Grunstein et al. | 2/69 |

FOREIGN PATENT DOCUMENTS

| | | |
|---|---|---|
| EP | 0 519 135 A1 | 12/1992 |
| FR | 2 558 350 A1 | 7/1985 |
| GB | 865488 | 4/1961 |
| GB | 1455472 | 11/1976 |
| GB | 1551891 | 9/1979 |
| JP | 2001 032104 | 2/2001 |
| WO | 99/53783 A1 | 10/1999 |

OTHER PUBLICATIONS

NRS Paddlesports Equipment Guide 2001, p. 12.*

* cited by examiner

*Primary Examiner*—Gloria M. Hale
*Assistant Examiner*—Alissa L. Hoey
(74) *Attorney, Agent, or Firm*—Akin, Gump, Strauss, Hauer & Feld, L.L.P.

(57) ABSTRACT

A close-fitting garment, especially a swimsuit, has panels of elastic stretch fabric joined at seams and shaped to conform with muscle groups of the body, in particular in the abdominal region and at the glutel region.

27 Claims, 6 Drawing Sheets

ARTICLES OF CLOTHING

BACKGROUND OF THE INVENTION

1. Field of the Invention

This invention has to do with articles of clothing which incorporate elastic stretch fabric and fit tightly to the body, for sports use or for general muscular support. Particular examples are described in relation to swimsuits, which are a preferred application, but the concepts described here can be applied to other kinds of specialised support or athletic wear.

2. Background

A variety of known sports garments, particularly swimsuits, but also athletic shorts and long johns, are made from elasticated stretch fabric which fits closely and tightly against the body. In recent years use has been made of various fabrics with high elastane content which, according to the knit used, combine various degrees of elastic stretch with a high stretch constant to press more firmly against the body surf ace for a given degree of stretch. In racing swimsuits this reduces the entry of water between the suit and body—a source of drag—and avoids the sliding of the fabric over the skin. It can also reduce muscle vibration which is believed to be a cause of fatigue and body drag in swimming.

BRIEF SUMMARY OF THE INVENTION

We now propose novel structures for articles of clothing of the kind described enabling improvements in achieving a highly-tensioned fit over the body, especially lower back and abdominal fit, and also preferably taking account of the disposition of muscles over the body.

In general terms, we have found that useful tensioned fit effects can be achieved by a special disposition of seams joining panels of elasticated stretch fabric in an article of clothing of the kind described. We have combined intensive investigation on the desired tensile elastic properties of various parts of the garment, in relation to athletic activities, with the observation that these elastic properties can be modified using the seams. In simple terms, introduction of a seam across a span of stretch fabric reduces the stretchability, i.e. potentially increases a degree of tensioning, in a direction transverse to the seam. In one particular development, we have found a novel positioning of seams which can be specifically used to improve tensioned lower back or abdominal fit in an athletic garment e.g. a racing swimsuit, covering the torso. In another, overlapping development we have found a disposition of seams providing an improved tensioned fit extending from the waist down onto the legs.

In one aspect of the invention we provide an article of clothing of stretchable elasticated fabric which covers at least the torso, having a waist region which surrounds the abdomen and is dimensioned and constructed to fit closely and under high tension around the wearers waist or lower back relative to the tension around the broader and stiffer chest and pelvic regions above and below. To achieve this we propose a particular arrangement of panel seams. In this arrangement the front or back of the suit, and preferably both has at each side (right and left) a pair of tensioning panel seams. From a convergence at the respective side of the waist, a lower one of these tensioning panel seams extends inwardly (medially) and downwardly onto the pelvic region and an upper one extends inwardly (medially) and upwardly to the neck region. We have found that these seams converging towards the sides at the waist provide a good structure for achieving a close tensioned fit of the suit.

At the waist side convergence the upper and lower panel seams preferably meet, are continuous or are linked by a connecting seam. Additionally, they preferably meet or are continuous with corresponding panel seams extending around to the opposite face (front or back) of the body. Most preferably these latter are tensioning panel seams in an arrangement as described above. The seams constitute a high-strength, relatively low extensibility feature. By having them meet top-to-bottom and/or back-to-front, tension which can be sustained in the fabric panels at this region is increased.

Note that this controlled distribution of tension for close fit is achievable using the same fabric stretch characteristics in the fabric of the different panels joined by the seams, unlike the suits described in U.S. Pat. No. 5,839,122 in which—for different reasons—panels of particularly stretch-resistant fabric are incorporated along selected axes of the suit. Likewise it can be achieved with a single layer of the fabric over the suit, by contrast with U.S. Pat. No. 4,698,847 which resorts to incorporating strapping beneath fabric panels to provide muscular support.

In terms of the shape of the fabric panels, the arrangement of tensioning seams described above may manifest itself as a generally rhomboidal or guadrilobed fabric region cantered on the abdomen (front) and/or lumbar region (back). Left and right side lobes correspond to the above-mentioned convergence of upper and lower panels seams. A top lobe extends up between the upper panel seams towards, and preferably reaching, the neck opening of the suit. A bottom lobe extends down towards the groin where it may terminate, or continue further if the suit has legs. Such an abdominal or lumbar panel may optionally have a vertical central seam for ease of manufacture, and this may incorporate a zip fastener for the suit.

It should be appreciated that the upper tensioning seams described here are distinct from the conventional sleeve-joining seams of a known sleeved suit. The latter pass closely under the armpit and do not approach the waist region. In our proposal the upper seams extend right down to the waist region, preferably from at or adjacent the front or back of the neck rather than from the adjacent shoulder joint. There is a close convergence or coincidence of the upper and lower panel seams at each side of the waist. Furthermore, even in a legless suit we generally provide a fabric panel to each side of the pelvis, laterally outside the lower tensioning seam(s), because these seams serve a distinct function in tensioning the adjacent fabric.

A further aspect of the present proposals applies generally to articles of clothing comprising panels of stretchable elasticated fabric fitting closely to the body. In this aspect, for at least one and preferably more than one different kind of the following active muscle areas;

shoulder girdle front;
shoulder girdle rears
gluteus maximus;
hamstring muscles;
quadriceps femoris;
gastrocnemius,
tibialis posterior, and
tibialis anterior;

(for each of which the left and right areas are separate but of the same kind), muscle area-specific fabric islands or zones are provided, bordered by panel-joining seams extending, preferably convexly curved, in surrounding or conformal relation to the respective muscle area. Preferably within the island or zone is a single uninterrupted fabric region. This has been found to improve tensioned fitting over the muscle groups concerned, and contrasts with previous swimming suits in which the provision of seams has been minimised, generally being restricted to the simplest centre lines, side lines and sleeve/leg attachments, and regarded as a necessary evil.

For the shoulder girdle, front or rear, the corresponding seam may join the shoulder panel to an abdominal or lumbar fabric region of the article and extend downwardly from adjacent the neck, curving laterally towards the waist. The specific front and rear muscle groups which may be affected are described later. As will be appreciated, this seam may also constitute an upper tensioning seam of the first aspect of our invention discussed above.

For each gluteal region (left and right) a respective panel island or zone can be provided. Preferably left and right gluteal zones are separated by a medial posterior fabric portion, or similar fabric. The characteristic seam for each gluteal zone can have a medial portion which curves up and out laterally towards the waist (for articles of clothing having a waist/torso part) and/or down and out laterally towards the outside of the upper leg (for articles of clothing having legs). The gluteal zone may have a lateral joining seam at the side of the pelvis, optionally extending down the outside of the upper leg. It will be appreciated that, in embodiments of the first aspect where a torso region of an article of clothing has the upper and lower side tensioning seams at the back, the lower of these may coincide with the seams for the gluteal zone boundaries at either side.

For articles of clothing having legs, a panel-joining seam for a fabric panel zone for the upper leg hamstring muscles may extend e.g. as an outwardly convex curve, from adjacent to the inside of the knee laterally out, up behind the leg and then medially inwardly again close below the gluteal region. Thus, it may complement a gluteal seam as mentioned above; their seams may be formed as a single continuous seam with oppositely-curved portions bordering the hamstring and gluteal regions respectively.

It will be appreciated from this instance that the muscle area boundary seams need not entirely surround or isolate the muscle areas. There may be a nexus or isthmus of one fabric region to another in directions where tensioning is less important, to reduce the number of fabric panels used.

For suits having legs, a fabric panel for the quadriceps region (front) of the upper leg may have an upper joining seam along the line of the groin. In suits embodying the first aspect above, this may also be the lower tensioning seam extending from the groin up around to the side of the waist. An outer side seam for the quadriceps region may be provided extending up and down the outside of the upper leg, preferably posteriorly convex. This may be separated by an intervening fabric region (e.g. a continuation down from the gluteal zone panel) from a hamstring muscle zone panel as mentioned above. Where the suit includes a lower leg covering, this may have a transverse seam at the knee separating the quadriceps region from the lower leg region. A corresponding transverse seam may also be provided at the back of the knee, far tensioning along the back of the leg.

Where there is a lower leg portion, panels specific for the tibialis anterior or posterior and/or gastrocnemius may be bordered by a panel-joining seam in the form of a loop which is elongate up the leg, preferably closed around its top adjacent the knee.

Where the suit has arms, preferably an upper torso panel of the suit has a shoulder region with a internal deltoid extension or 'epaulette' out onto the outer side of the upper arm where it terminates at a transverse boundary with one or more longitudinal arm panels. Arm panels may be further longitudinally sub-divided by a transverse seam at the elbow, back and/or front.

One novel useful option, presented here also as an independent proposal in relation to a suit having arms is that the fabric at the inside of the forearm may be more uneven than the fabric at other parts of the suit, e.g. a rough-weave fabric. This is analogous to high-performance swimmers' practice in not shaving their forearms, the aim being to promote minor surface turbulence over the surface and thereby avoid gross flow separation and eddies behind the arm which adversely affect the motion of the arm through the water.

The elastic stretch fabric used to make the suit may be of any suitable kind. Fabrics of high stretch constant e.g. polyester elastanes as conventionally used for making high-performance swimwear, are within the skilled person's routine knowledge.

Insofar as the article of clothing is dimensioned and seamed to achieve high tension over the wearer's body, it is preferred, as already widely practised in racing swimwear to use Flatlock or Flatseam (flat seams made with e.g. six or seven spools of thread and which cover the fabric edges) for the panel seams. It is also desirable in the present proposals to increase the number of stitches per unit length in the relevant seams. At least at high tension regions of the suit (e.g. abdominal/lower back tensioning seams mentioned above) the number of stitches per 3 cm is preferably at least 20 and more preferably at least 24.

Other measures may be used for reducing the drag of the suit in the water. One option is the use of longitudinal water-repellent stripes e.g. printed with fluorocarbon such as PTFE. This is known. Another possibility is the application of arrays of small surface protrusions at suit regions where the wearer's body curves to a rearward-facing surface, particularly the chest in women's suits. See e.g. U.S. Pat. No. 4,972,522, WO96/2052, JP-A-09/111514. These and other similar proposals have the effect of delaying boundary layer breakaway on the body surface.

A further new proposal herein is to provide extra insert panels localised at the inside angle of arm or leg joints, i.e. at the armpit or groin. By inserting discrete panels the fit of the garment can be tailored closer to the body, reducing the normal tendency for high tension in the surrounding fabric to space fabric away from the body surface at these regions.

The garment may cover e.g.

(i) the whole body, including the full length of the arms and legs;

(ii) as (i) but not the arms;

(iii) as (i) or (ii) but not the legs, or the legs only down to knee-length;

(iv) the midriff and legs only, either full-length (long-john), shorts or knee-shorts (v) the torso only, i.e. no arms or legs.

BRIEF DESCRIPTION OF THE SEVERAL VIEWS OF THE DRAWINGS

Preferred embodiments of the invention are now described by way of example as applied to racing swimsuits, with reference to the accompanying drawings in which.

DETAILED DESCRIPTION OF THE INVENTION

Figures 1, 2, 3:
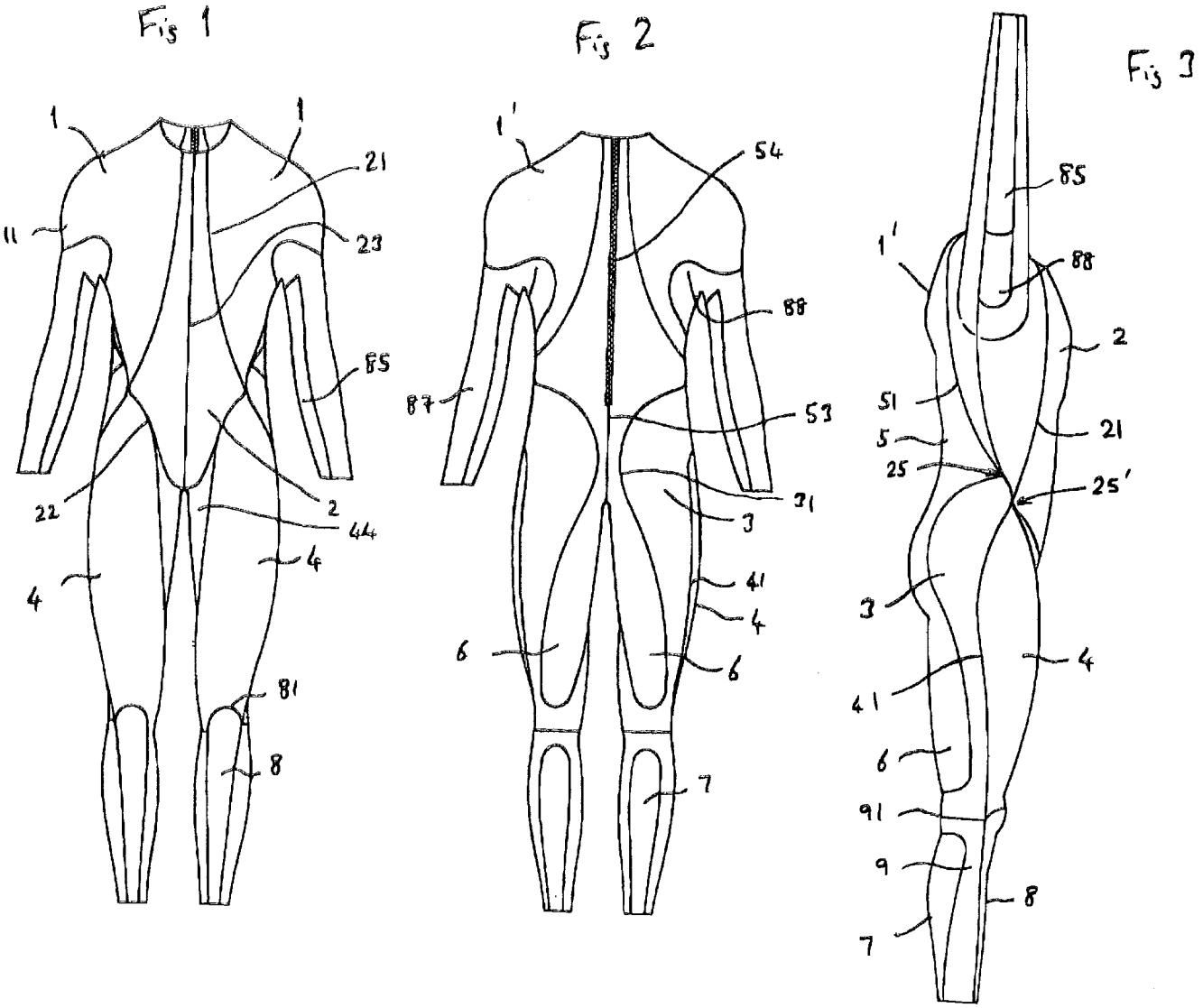
FIG. 1 is a front view of a full body suit.
FIG. 2 is a back view of the FIG. 1 suit.
FIG. 3 is a side view of the same suit.

The illustrated suite are all made from single-layer panels of high stretch-constant polyester elastane fabric of a known kind. FIG. 1 shows a full body suit which covers and fits closely over the entire torso, also the arms to the wrists and the legs to the ankles.

A characteristic feature of the suit is a unique disposition of multiple specially-shaped fabric panels with panel seams between them, which creates a tensioned fit of the suit over the wearer's body.

The torso region of the suit consists of the following panels. Left and right anterior shoulder-thorax panels 1 and left and right posterior shoulder-thorax panels 1' are joined along the tops of the shoulders. An abdominal panel 2, including an upward extension to the centre of the neck opening, meets the anterior shoulder-thorax panels 1 along left and right upper abdominal reinforcement or tensioning seams 21. A lumbar panel 5 is similarly disposed in relation to the posterior shoulder-thorax panels 1', and joined to them along respective posterior connecting seams 51 extending up to the neck opening. A zip fastener 54 extends up the middle of the upward extension of the lumbar panel 5.

The abdominal panel 2 is generally rhomboidal. In this embodiment it is formed in two halves joined by a central vertical seam; this helps in fitting. The upper apex of the rhombus extends up to the centre of the neck opening. The left and right apices extend sideways around to the respective sides of the waist. The lower apex extends down into the groin, and is joined to the front upper leg panels 4 along lower abdominal reinforcement seams 22 slanting down from waist to groin.

The upper abdominal tensioning seams 21 extend down side-by-side from adjacent the centre of the neck opening, diverging slightly down the thorax and then curving laterally away from one another, roughly along the lower line of the ribcage, to the sides of the trunk at the waist. The disposition of these seams is such as to lie substantially perpendicular to a line between the hand on that side and the opposite knee during typical swimming motions, with the hand extended. Under the shoulder panel 1 lie the anterior deltoid, the insertion of the latissimus dorsi and the pectoralis major, which cooperate in the characteristic sweeping pull of the arm in swimming. Pressure from the stretched fabric panel acts on these muscles as they work. At the same time, the supraspinatue, infraspinatus and teres minor muscle group functions at the posterior of the shoulder under the similar benign influence of the posterior shoulder panel 1' to maintain integrity of the shoulder joint as it works.

At the back, the posterior shoulder panels 1' extend down the side of the thorax and beneath the armpit, like the corresponding anterior panels 1. The corresponding upper tensioning panel seams 51 extend down side-by-side from adjacent the centre of the neck opening in the same way to either side of the spine, and curve out laterally to meet the front abdominal tensioning seams 21 at a waist girdle seam node 25 at the side of the body (see FIG. 3), extending beneath the latissimus dorsi region. The convergence of seams at the waist girdle area gives tensile strength enabling the abdominal and lumbar panels 2,5 to be placed under maximum extension in this region.

Unlike the abdominal panel 2, and unlike a conventional leg join, the lower extremity of the lumbar panel 5 does not extend down to the groin as a rhomboidal apex. Rather, the lower posterior connecting seams 52 extend from the side nodes 25—where preferably they are continuous with the upper connecting seams 51—medially along the top of the gluteus maximus muscle, defining the contour of left and right gluteal panels 3 shaped as respective convex lobes which correspond to the gluteus maximus outline. Note: in this respect they differ structurally and functionally from the buttock support seams seen in GB-A-1551891, which traverse across rather than round the gluteus maximus, and at an outer region thereof. The lower lumbar seams 52 curve downwardly and medially to either side of a narrow isthmus, 64 of the lumbar panel 5's downward extremity, as gluteal zone border seams 31 passing down the inner sides of the buttocks. These seams curve laterally out and down and then reverse their direction of curvature to continue down the leg along the outer (lateral) border of the hamstring muscle group. Thence they constitute border seams 61 of left and right hamstring muscle panels 6 which are integral continuations down from the lumbar panel 5 above. The hamstring panel seam 61 curves medially again around the bottom of the hamstring muscle group adjacent the knee where it meets a vertical inside leg seam.

At the front of the leg, an anterior femoral panel 4, joined at the lower abdominal seam 22, of the abdominal panel 22 extends down to the knee, covering the quadriceps femoris muscle group which acts to extend the leg. Groin fitting panels 44 are inserted at the inner junction of the suit leg and front torso parts. These fit the fabric more closely into the groin so that tension in the neighbouring leg fabric does not space the fabric away from the body of the groin, potentially causing drag.

Lateral femoral seam 41 runs down the outside of each leg, posteriorly convex, from the seam node 25, and is crossed at the knee by an encircling knee joint seam 91 effectively dividing the leg material into four fabric areas; femoral and lower leg, front and rear.

The rear femoral construction includes a narrow downward extension in one piece with the gluteal panel 3, occupying the variable-width region between the curving seam 61 of the hamstring group panel 6 and the straighter lateral seam 41 of the anterior femoral panel 4. This downward extension from the gluteal panel 3 broadens beneath the hamstring muscle panel 6 to join across the transverse knee joint seam 91 to the lower rear (calf) panel 9. The generally rectangular form of this lower rear panel 9 is largely occupied or interrupted by a generally oval gastroenemius panel 7 having a long bight of surround seam 71 extending around the contour of the gastroenemius muscle pair and down to the ankle opening of the suit.

The front lower leg panel is similarly interrupted by a long bight of surround seam 81 surrounding a tibialis anterior panel.

The front and rear shoulder-thorax panels 1, 1' have epaulette portions 11,11' which extend over the shoulder and onto to the upper arm where they are seamed to the tubular arm panels proper. These include an inner arm panel 85 from the wrist to the armpit panel 88, and an outer arm panel 87. The seams running up the front and back of the arms from the wrist allow the arm fabric panels to be shaped for a tight fit around the forearm muscles, and the biceps and triceps of the upper arm. By having multiple panels this tightness can be adjusted to compress the muscles optimally according to known principles.

In the armpit, as at the groin, a small insert panel 88 is used to tailor the fit of the suit closely up under the arm.

The present seam and panel disposition improves the tensioned fit aspects of the suit. Longer pieces of fabric tend to have proportionally higher stretchability than the same length of the same fabric interrupted or traversed by seams. Furthermore, fabrics typically have different stretchabilities in the warp and weft directions.

The conformal gluteal panels 3 compress the large gluteus maximus muscle for enhanced muscle action in the swimmer's propulsive kick.

The long fabric panel 6 corresponding to the hamstring muscle groups enhances the motion of these muscles, which cross the hip joint as well as the knee joint.

The lower leg rear panel 7 around the contour of the gastrocnemius muscle isolates that muscle which is important in the kick, as it enlarges the kicking surf ace by pointing the toes. As with the other seams in the suit, disposing the panel seams 71 around the contour of the relevant muscle group causes tension in the suit to be applied favourably over the muscle in question.

The front seam 81 on the lower leg isolates tibialis anterior for optimal compression by the responding conformal panel 8. Tibialis anterior is used in the kicking motion.

It will be appreciated from the description, arid from the variety of preferred embodiments described herein, that the invention comprehends garments which are characterized by any one or more selected from the respective distinctive arrangements of panels/seams provided in relation to each of the muscles, muscle groups or muscle areas discussed herein.

Figure 4:
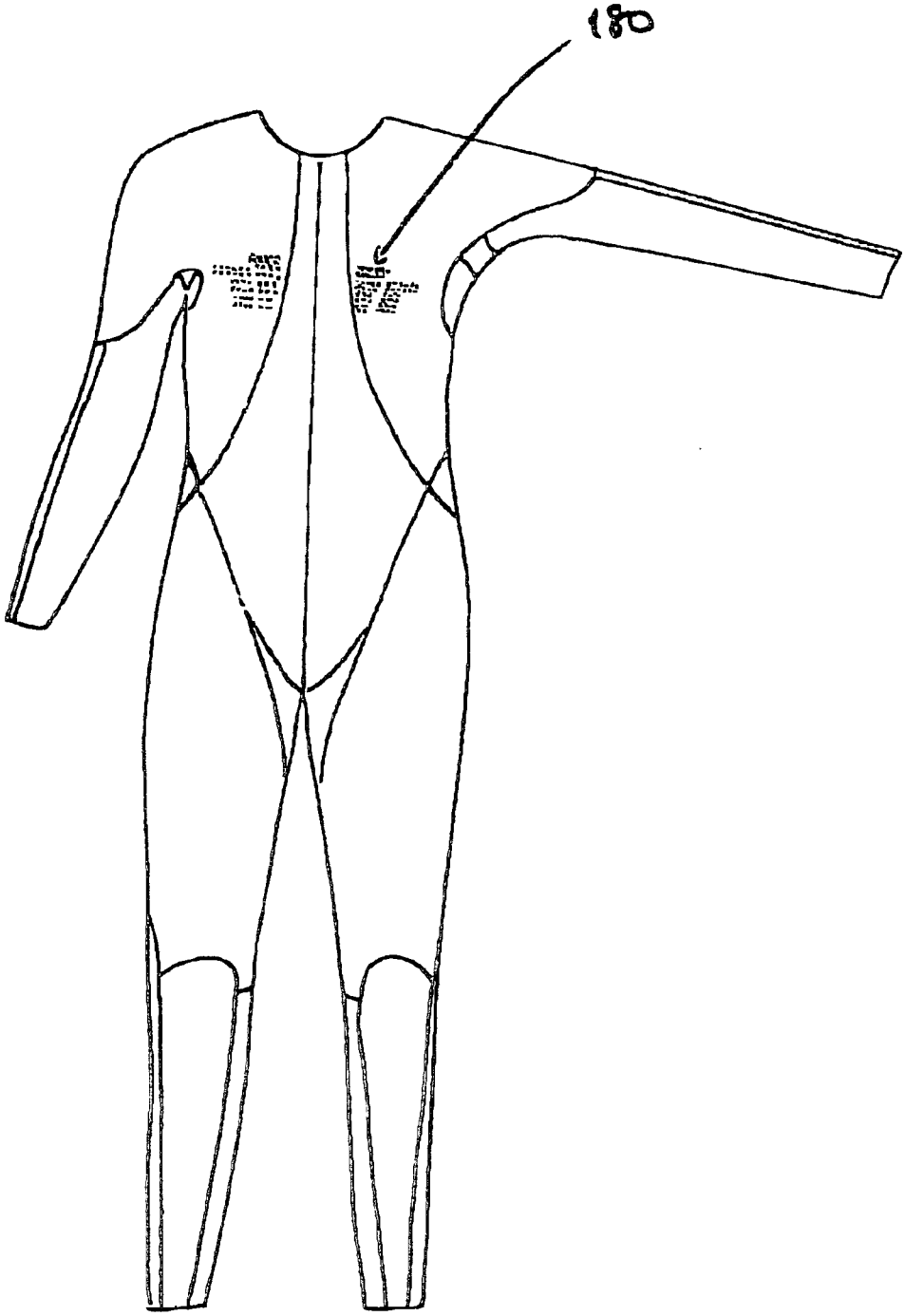
FIG. 4 is a front view of a variant showing vortex controllers.

FIG. 4 shows a variant in which the chest region of the suit is provided with arrays of vortex-inducing protrusions as disclosed in JP-A-O9/111514. In this embodiment they are adhered silicone plastic cones about 1.5 mm in height.

Figure 7:
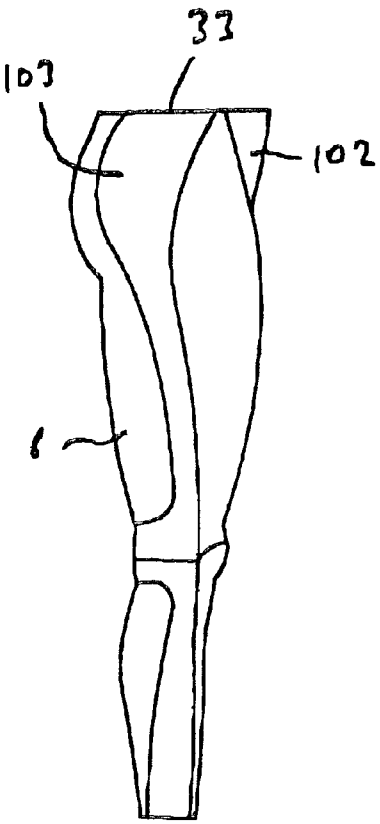
FIGS. 5, 6 and 7 are a long-john swimsuit from the front, back and side.
Figure 6:
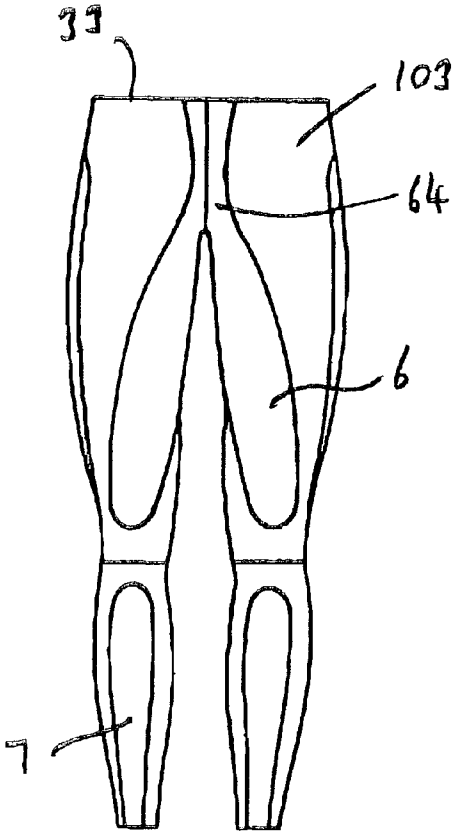
Figure 5:
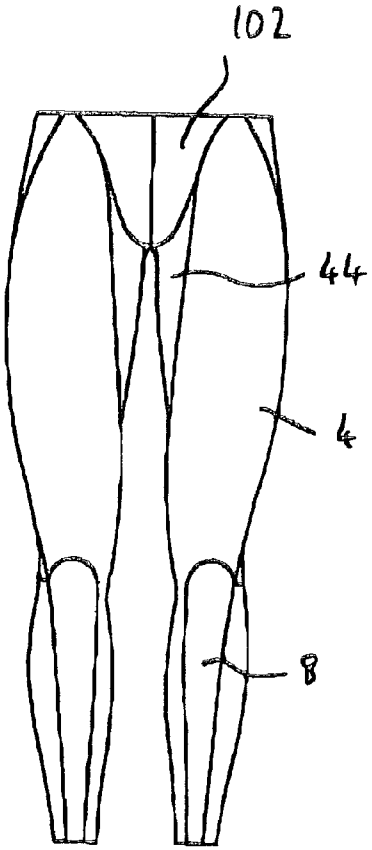

FIGS. 5 to 7 are corresponding views of a long john or leg suit. The arrangement of suit panels corresponds exactly to the full body suit of FIG. 1, but truncated at the waist. Thus, the abdominal panels 102 are foreshortened between the waist band 33 and groin seams 22. However the tensioned fitting of the gluteal and leg muscle zone panels is the same as in the first embodiment.

Figure 10:
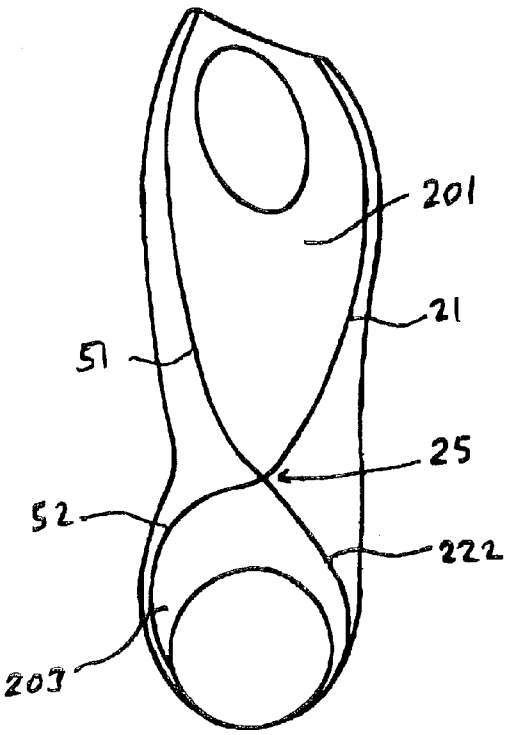
FIGS. 8, 9 and 10 are a women's high leg swimsuit from the front, back and side.
Figure 9:
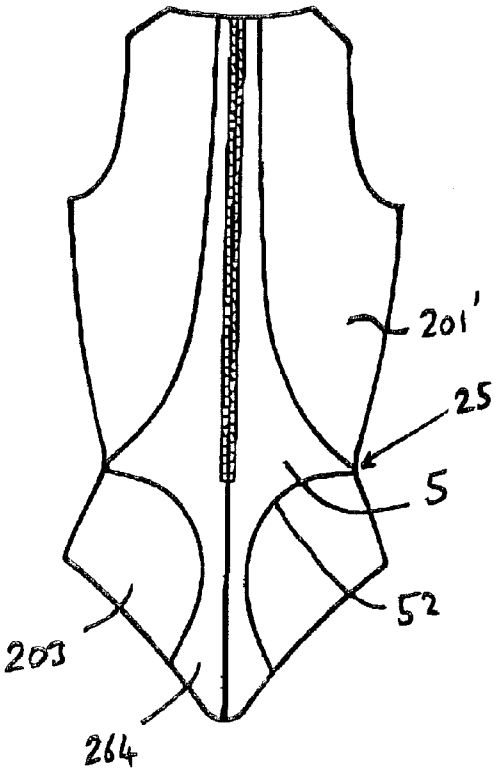
Figure 8:
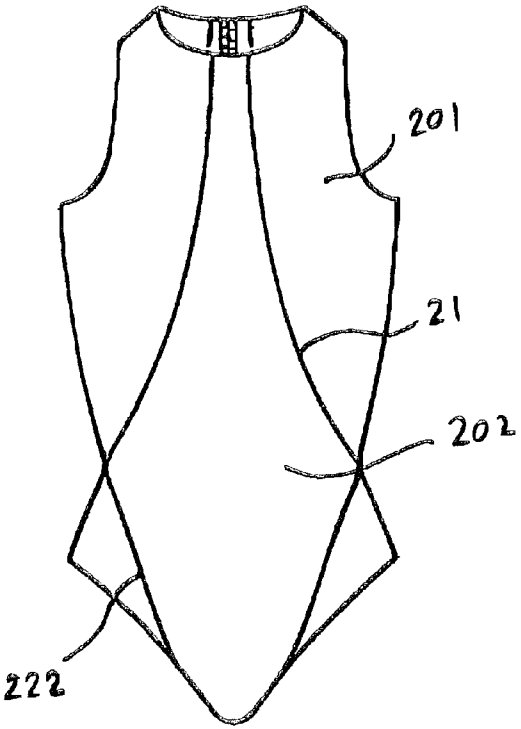

FIGS. 8 to 10 are corresponding views of a standard women's one-piece bodysuit, with a high neck but without arms or legs. The structures of the reinforcing and supporting seams 21,22 (front) and 51,52 (back) are retained. The previous shoulder-thorax panels 1,1' are foreshortened so as substantially to exclude the deltoid region, but still provide a tensioning across the diagonal of the suit body as before.

Figures 11, 12, 13:
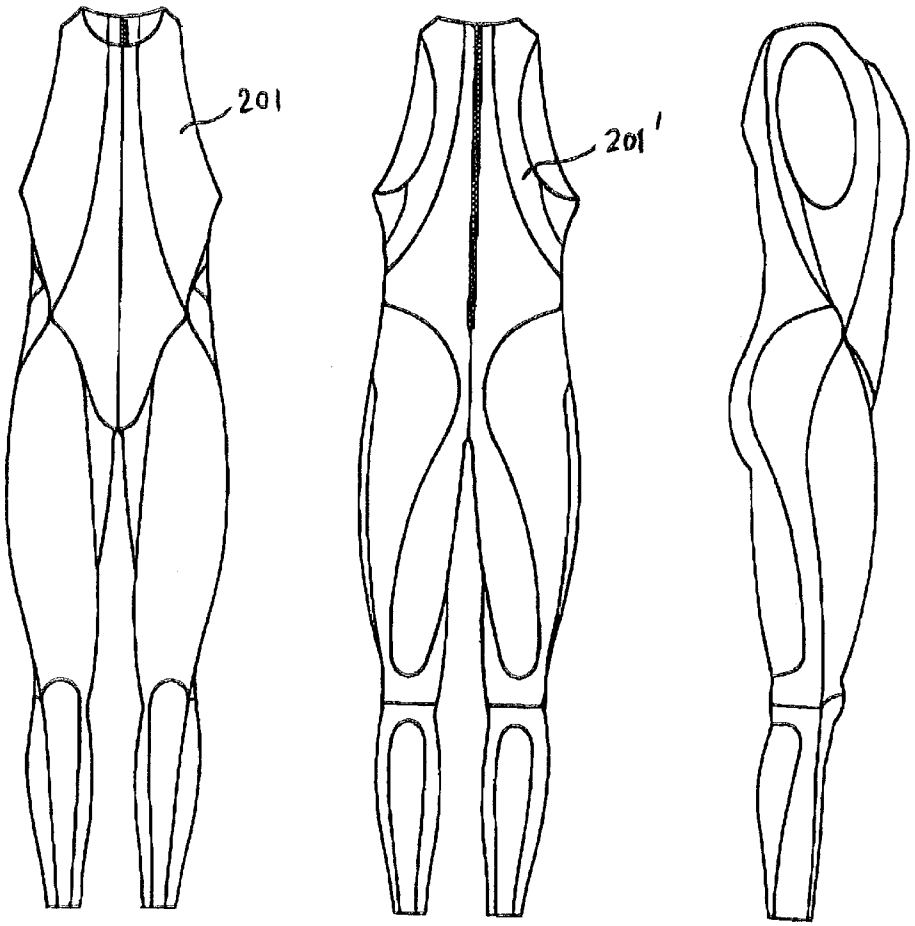
FIGS. 11, 12 and 13 are a body and leg suit without arms, from the front, hack and side.

FIGS. 11 to 13 show a suit corresponding to that of FIGS. 1 to 3 except that as in the suit of the previous embodiment there are no arms and the shoulder-thorax panels 201, 201' are foreshortened. The other structures and functions of the suit are as previously.

There is a choice of fabrics for the suit, and the possibility of selected orientation of directional fabrics. For example, in line with modern developments one may use stretch fabric printed to have alternating water-repellent and non-water-repellent stripes, as in JP-A-09/049107, to create drag-reducing surface turbulence.

In general it is known to be preferred to align the stripes with the body length of the body.

Figure 14:
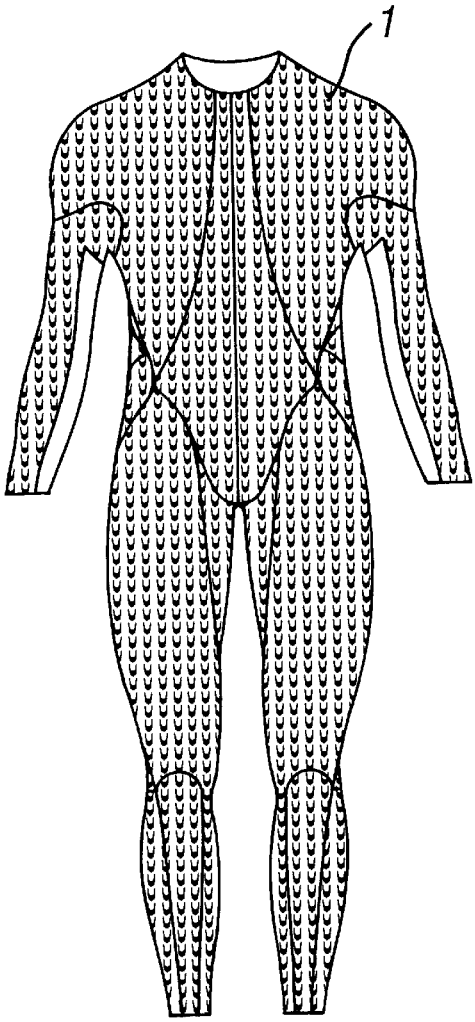
FIGS. 14 and 15 show a preferred disposition of low-drag fabric surface features which are preferably used, on the FIG. 1 and other suit types.
Figure 15:
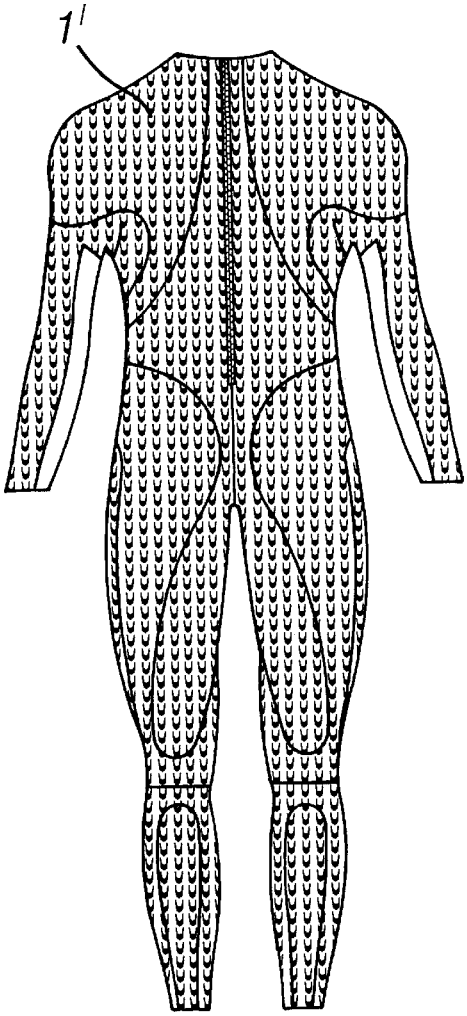

An alternative, preferred, is a fabric provided with embossed riblets, separating minute parallel grooves in the fabric surface. The fabric panels are arranged so that the riblets extend generally longitudinally of the body. FIGS. 14 and 15 show a suit which additionally has a water-repellent coating (PTFE) covering the entire surface of the fabric except for an array of repeating shape elements where the fabric is exposed. The shape elements in their multidirectional array can line up in. "stripes" in more than one direction, giving the effect of repellent/non-repellent strips in the longitudinal direction of the body even where the body's intricate contours mean that the orientation of the fabric weave cannot always be the same.

It is also possible for the inside arm panels 85 to use a relatively uneven fabric, for reasons mentioned previously. We propose the use of a dimpled finish fabric, e.g. a warp knitted fabric having a micro-relief dimple surface effect and optional PTFE chemical finish. This generates turbulence very close to the surface, reducing separation of the water flow around the arm, Like the other fabrics used in the suit, it is a compressive stretching polyester elastane.

It should be appreciated that these are only preferred examples and useful results can be obtained with other fabrics.

Because of the high tension in the suit when worn, the various seams are stitched flat with seven lines of thread—which is in itself a conventional mode of panel seaming—but also with a higher than normal stitch density, in this example 26 stitches per 3 cm.

We claim:

1. A close-fitting garment comprising panels of stretchable elasticated fabric joined at flat seams, the garment having at least a torso region, the torso region having a front neck region, an abdominal region and a pelvic region, the abdominal region including a waist region and the pelvic region including a groin region, wherein a front of the torso region of the garment has the following seams:

a left front upper abdominal tensioning seam extending from a left waist girdle seam node, at the left side of the waist region, medially and upwardly to terminate at the front neck region;

a right front upper abdominal tensioning seam extending, from a right front waist girdle seam node, medially and upwardly to terminate at the front neck region;

a left front lower abdominal tensioning seam extending from the left waist girdle seam node, where it is connected to the left front upper abdominal tensioning seam, medially and downwardly across the pelvic region to the groin region, and a right front lower abdominal tensioning seam extending from the right waist girdle seam node, where it is connected to the right front upper abdominal tensioning seam, medially and downwardly across the pelvic region to the groin region.

2. A close-fitting garment according to claim 1 in which said left front upper and lower and right front upper and lower abdominal tensioning seams surround a front abdominal panel, the front abdominal panel being generally rhomboidal, having an upper apex at the center of the front neck region, a lower apex at the groin region and left and right apices at respective sides of the waist region.

3. A close-fitting garment according to claim 1 in which a back of the torso region has the following seams:

a left back upper abdominal tensioning seam extending medially and upwardly from the left side of the waist region;

a right back upper abdominal tensioning seam extending medially and upwardly from the right side of the waist region;

a left back lower abdominal tensioning seam extending from the left side of the waist region medially across behind the pelvic region, and a right back lower abdominal tensioning seam extending from the right side of the waist region medially across behind the pelvic region.

4. A close-fitting garment according to claim 1 having left and right leg portions.

5. A close-fitting garment according to claim 1 in which the number of stitches per centimeter in said flat seams is at least 24.

6. A close-fitting garment according to claim 1 in which said fabric panels of the torso region are all of substantially similar elasticated fabric.

7. A close-fitting garment according to claim 6 in which all said fabric panels are of polyester elastane fabric.

8. A close-fitting garment comprising panels of stretchable elasticated fabric joined at flat seams, the garment having at least a torso region, the torso region having a neck region, an abdominal region and a pelvic region, and the abdominal region including a waist region;

wherein a back of the torso region of the garment has the following seams:

a left back upper abdominal tensioning seam extending from a left waist girdle seam node, at the left side of the waist region, medially and upwardly to terminate at the neck region;

a right back upper abdominal tensioning seam extending from a right waist girdle seam node, at the right side of the waist region, medially and upwardly to terminate at the neck region;

a left back lower abdominal tensioning seam extending from the left waist girdle seam node, where it is connected to the left back upper abdominal tensioning seam, medially and downwardly across the pelvic region, and a right back lower abdominal tensioning seam extending from the right waist girdle seam node, where it is connected to the right back upper abdominal tensioning seam, medially and downwardly across the pelvic region.

9. A close-fitting garment according to claim 8 having left and right leg portions.

10. A close-fitting garment according to claim 8 which said panels of stretchable elasticated fabric include left and right gluteus maximus panels, bordered respectively by left and right gluteal seams which extend medially from the left and right sides of the waist region respectively and curve downwardly as they approach each other medially, such that in use they extend medially along the top of a respective buttock of a wearer and curve downwardly around a medial border of the buttock.

11. A close-fitting garment comprising panels of stretchable elasticated fabric joined at flat seams, the garment having at least a torso region, the torso region having a neck region, an abdominal region and a pelvic region, and the abdominal region including a waist region, a front of the torso region having the following seams:

a left front upper abdominal tensioning seam extending medially and upwardly from a left side of the waist region to the front of the neck region;

a right front upper abdominal tensioning seam extending medially and upwardly from a right side of the waist region to the front of the neck region;

a left front lower abdominal tensioning seam extending from the left side of the waist region, medially across the front of the pelvic region, and a right front lower abdominal tensioning seam extending from the right side of the waist region, medially across the front of the pelvic region;

a back of the torso region having the following seams:

a left back upper abdominal tensioning seam extending medially and upwardly from the left side of the waist region;

a right back upper abdominal tensioning seam extending medially and upwardly from the right side of the waist region;

a left back lower abdominal tensioning seam extending from the left side of the waist region, medially across behind the pelvic region, and a right back lower abdominal tensioning seam extending from the right side of the waist region medially across behind the pelvic region, and wherein said left front upper and lower abdominal tensioning seams are continuous with or are linked by a connecting seam with the left back upper and lower abdominal tensioning seams at the left side of the waist region, and the right front upper and lower abdominal tensioning seams are continuous with or are linked by a connecting seam with the right back upper and lower abdominal tensioning seams at the right side of the waist region.

12. A close-fitting garment according to claim 11 having left and right leg portions.

13. A close-fitting garment according to claim 12 in which the leg portions are knee length.

14. A close-fitting garment according to claim 12 in which the leg portions are full-length.

15. A close-fitting garment according to claim 11 in which said panels of stretchable elasticated fabric include left and right gluteus maximus panels, bordered respectively by left and right gluteal seams which extend medially from the left and right sides of the waist region respectively and curve downwardly as they approach each other medially, such that in use they extend medially along the top of a respective buttock of a wearer and curve downwardly around a medial border of the buttock.

16. A close-fitting garment according to claim 15 in which the left and right gluteal seams are continuations of the left and right back lower abdominal tensioning seams.

17. A close-fitting garment according to claim 11 in which the garment comprises left and right leg portions each comprising front and back fabric leg panels, and said front fabric leg panels are joined to the torso region of the garment at the respective lower abdominal tensioning seams.

18. A close-fitting garment according to claim 11 comprising left and right full-length leg portions in which each leg portion has front and upper fabric panels extending down to the knee, and front and back lower fabric panels extending down from the knee, and a knee joint seam extending around the leg portion at the knee to divide the upper fabric panels from the lower fabric panels.

19. A close-fitting garment according to claim 11 in which said fabric panels of the torso region are all of substantially similar elasticated fabric.

20. A close-fitting garment according to claim 11 in which all said fabric panels are of polyester elastane fabric.

21. A close-fitting garment comprising panels of stretchable elasticated fabric joined by flat seams, the garment having a torso portion and left and right leg portions joined to the torso portion, the torso portion having a neck region, an abdominal region and a pelvic region, and the abdominal region including a waist region;

the leg portions comprising at least front and back leg panels, the front and back leg panels of each leg portion being joined to the torso portion of the garment by front lower abdominal seams and back lower abdominal seams which extend from respective sides of the waist region medially across a front and back of the pelvic region;

a front of the torso portion having a left front upper abdominal tensioning seam extending upwardly from a left side of the waist region toward a front of the neck region, and a right front upper abdominal tensioning seam extending upwardly from a right side of the waist region toward a front of the neck region;

said left and right front upper abdominal tensioning seams converging with the respective left and right front lower abdominal seams at respective sides of the waist region, and being continuous with or linked by a connecting seam with the respective lower abdominal seams;

a back of the torso portion having a left back upper abdominal tensioning seam extending upwardly from the left side of the waist region, and a right back upper abdominal tensioning seam extending upwardly from the right side of the waist region;

said left and right back upper abdominal tensioning seams converging with said left and right back lower abdominal seams at the left and right sides of the waist region respectively, and being continuous with or linked by a connecting seam with the respective said left and right back lower abdominal seam.

22. A close-fitting garment according to claim 21 in which said panels of stretchable elasticated fabric include left and right gluteus maximus panels, bordered respectively by left and right gluteal seams which extend medially from the left and right sides of the waist region respectively and curve downwardly as they approach each other medially, such that in use they extend medially along the top of a respective buttock of a wearer and curve downwardly around a medial border of the buttock.

23. A close-fitting garment according to claim 22 in which the left and right gluteal seams are continuations of the left and right back lower abdominal tensioning seams.

24. A close-fitting garment according to claim 21 in which the leg portions are full-length leg portions in which each leg portion has front and back upper fabric panels extending down to the knee, and front and back lower fabric panels extending down from the knee, and a knee joint seam extends around the leg portion at the knee to divide the upper fabric panels from the lower fabric panels.

25. A close-fitting garment according to claim 21 in which the number of stitches per centimeter in said flat seams is at least 24.

26. A close-fitting garment according to claim 21 in which said fabric panels of the torso region are all of substantially similar elasticated fabric.

27. A close-fitting garment according to claim 21 in which all said fabric panels are of polyester elastane fabric.

* * * * *